US006867791B2

(12) United States Patent
Shimmura

(10) Patent No.: US 6,867,791 B2
(45) Date of Patent: Mar. 15, 2005

(54) IMAGE FORMING APPARATUS AND IMAGE FORMING METHOD

(75) Inventor: Shoko Shimmura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 105 days.

(21) Appl. No.: 10/390,641

(22) Filed: Mar. 19, 2003

(65) Prior Publication Data

US 2004/0184859 A1 Sep. 23, 2004

(51) Int. Cl.[7] ..... B41J 2/385; B41J 2/47; B41J 2/455; G03G 15/043; G03G 15/01

(52) U.S. Cl. ..... 347/117; 347/135; 347/240; 347/233; 399/51; 399/181

(58) Field of Search ..... 400/118.2; 347/111, 347/233, 240, 115–118, 251–253, 135, 130; 399/178, 223, 51, 181

(56) References Cited

U.S. PATENT DOCUMENTS

| | | | | | |
|---|---|---|---|---|---|
| 4,864,326 | A | * | 9/1989 | Kawamura et al. | 347/240 |
| 4,875,057 | A | * | 10/1989 | Hediger et al. | 347/242 |
| 5,198,852 | A | * | 3/1993 | Mikami | 399/30 |
| 5,309,182 | A | * | 5/1994 | Mama et al. | 347/117 |
| 5,381,212 | A | * | 1/1995 | Noguchi et al. | 399/159 |
| 5,448,278 | A | * | 9/1995 | Tanimoto et al. | 347/129 |
| 5,761,570 | A | * | 6/1998 | Sawayama et al. | 399/49 |
| 5,786,594 | A | * | 7/1998 | Ito et al. | 250/236 |
| 5,828,397 | A | * | 10/1998 | Goto et al. | 347/131 |
| 5,926,203 | A | * | 7/1999 | Shimura et al. | 347/238 |
| 5,973,716 | A | * | 10/1999 | Morita et al. | 347/233 |
| 5,987,193 | A | * | 11/1999 | Eguchi et al. | 382/318 |
| 6,064,412 | A | * | 5/2000 | Goto et al. | 347/131 |
| 6,108,501 | A | * | 8/2000 | Nagai | 399/116 |
| 6,137,522 | A | * | 10/2000 | Melino et al. | 347/233 |
| 6,160,610 | A | * | 12/2000 | Toda | 355/41 |
| 6,163,333 | A | * | 12/2000 | Kamioka | 347/241 |
| 6,172,788 | B1 | * | 1/2001 | Suzuki et al. | 359/204 |
| 6,198,495 | B1 | * | 3/2001 | Sawada | 347/233 |
| 6,330,020 | B1 | * | 12/2001 | Kamioka | 347/241 |
| 6,393,228 | B2 | * | 5/2002 | Hisano | 399/49 |
| 6,636,251 | B2 | * | 10/2003 | Saitou et al. | 347/131 |
| 6,700,595 | B2 | * | 3/2004 | Sugiyama et al. | 347/133 |
| 2004/0125193 | A1 | * | 7/2004 | Kubo | 347/233 |

FOREIGN PATENT DOCUMENTS

| | | |
|---|---|---|
| JP | 2002-166592 A | 6/2002 |
| JP | 2002-166593 A | 6/2002 |

* cited by examiner

*Primary Examiner*—Andrew H. Hirshfeld
*Assistant Examiner*—Wasseem H. Hamdan
(74) *Attorney, Agent, or Firm*—Foley & Lardner LLP

(57) ABSTRACT

An image forming apparatus includes an electrophotographic developing device, a photosensitive body, a precharger for precharging the photosensitive body, and exposing units of two optical systems with different light amount distributions, which are provided for one photosensitive body for forming electrostatic latent images on the photosensitive body. The exposing units are selectively used.

18 Claims, 8 Drawing Sheets

IMAGE FORMING APPARATUS AND IMAGE FORMING METHOD

BACKGROUND OF THE INVENTION

The present invention relates to an image forming apparatus and an image forming method for reading an image on an original and forming an image using electrophotography.

In a conventional digital electrophotographic image forming apparatus using electrophotography, an exposing unit, which comprises, in general, a semiconductor laser or an LED optical system, is used as means for writing an electrostatic latent image on a photosensitive body.

The exposing unit comprising the semiconductor laser uses one or more laser beams. The diameter of each beam is reduced by a converging lens, and a polygon mirror is operated to cause the beam to scan the entire surface of the photosensitive body, thereby writing image data thereon. Thus, there is no possibility of a variance in exposure amount, but the volume of the whole exposing unit increases due to the need to provide various lenses and mirrors.

On the other hand, the exposing unit comprising the LED optical system is advantageously suited to reduction in size, since its components are only LED elements and a substrate. However, it is difficult to realize uniform light emission by suppressing a variance in light amount among light-emitting elements.

Even where either of the above exposing units with the associated optical systems is used, it is difficult to form an optimal electrostatic latent image for reproduction of a low-density part, and so high-density picture dots are formed at a low resolution or an unstable electrostatic latent image is used. Consequently, image development becomes unstable, and toner is attached non-uniformly, leading to degradation in halftone graininess.

As a result, it is difficult to achieve both of good sharpness of a line part and graininess of a solid part, and a high-quality image cannot be formed.

BRIEF SUMMARY OF THE INVENTION

The object of an aspect of the present invention is to provide an image forming apparatus and an image forming method, which can form a high-quality image by achieving both of good line-part sharpness and solid-part graininess.

In order to achieve the object, the present invention may provide an image forming apparatus that includes a photosensitive body, on which an electrostatic latent image is formed, and forms an image, the apparatus comprising: a first exposing unit that effects exposure with a first light amount distribution, thereby forming an electrostatic latent image on the photosensitive body; a second exposing unit that effects exposure with a second light amount distribution, differently from the first exposing unit, thereby forming an electrostatic latent image on the photosensitive body; and a control unit that effects a control to expose the photosensitive body using one of the first exposing unit and the second exposing unit in accordance with image data for image formation.

The invention may also provide an image forming method for an image forming apparatus that includes a photosensitive body, on which an electrostatic latent image is formed, and forms an image, the method comprising: effecting a control to expose the photo-sensitive body, when an electrostatic latent image is formed on the photosensitive body, with a first light amount distribution or a second light amount distribution different from the first light amount distribution in accordance with image data.

Additional objects and advantages of an aspect of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

Figure 1:
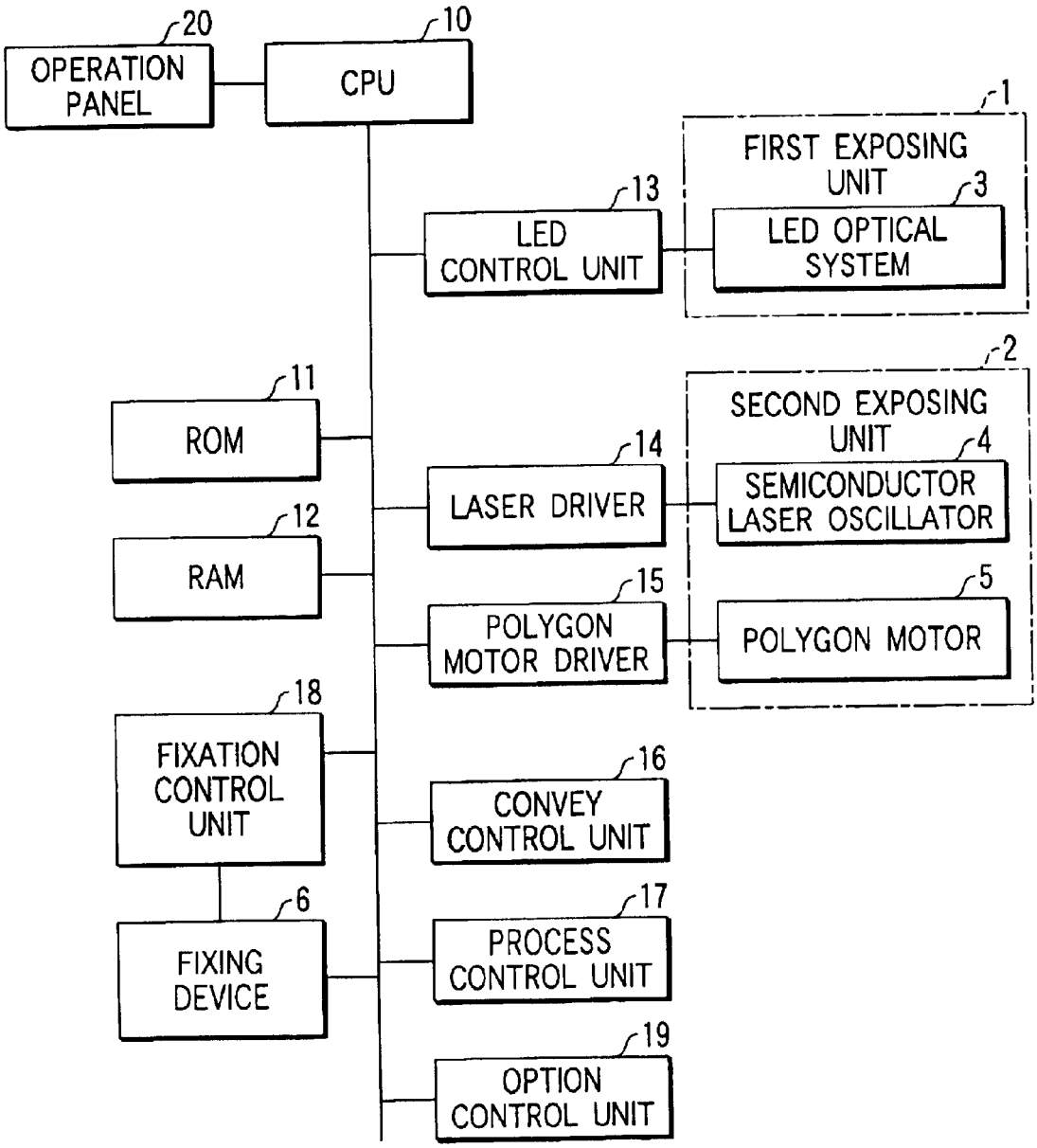
FIG. 1 is a block diagram schematically showing the structure of a digital electrophotographic image forming apparatus relating to an image forming apparatus according to an embodiment of the present invention.

FIG. 1 schematically shows the structure of a digital electrophotographic image forming apparatus relating to an image forming apparatus according to an embodiment of the present invention.

The digital electrophotographic image forming apparatus comprises a CPU 10 that controls the entirety; a ROM 11 that stores control programs, etc.; a RAM 12 for storing data; an LED control unit 13 that controls an LED optical system 3 of a first exposing unit 1; a laser driver 14 that drives a semiconductor laser oscillator 4 of a second exposing unit 2; a polygon motor driver 15 that drives a polygon motor 5 of the second exposing unit 2; a convey control unit 16 that controls conveyance of paper sheets; a process control unit 17 that controls a process of charging, development and transfer using a precharger, a developing device and a transfer device (to be described later); a fixation control unit 18 that controls a fixing device 6; and an option control unit 19 that controls options.

An operation panel 20 for effecting input operations for image formation, such as mode setting, is connected to the CPU 10.

The semiconductor laser oscillator 4 usable in this invention may be a publicly known exposing device, for example, a publicly known laser optical system, such as a GaAlAs semiconductor laser (wavelength: about 750 nm), an InGaAlP semiconductor laser (wavelength: about 680–840 nm), a GaN semiconductor laser (wavelength: about 375–475 nm), a diode-excitation solid-state laser (wavelength: about 532–635 nm), or a surface-emission laser.

The LED optical system 3 is also a publicly known exposing device.

A multi-beam exposing device may be used. In the present invention, as will be described later in detail, two or more exposing units of optical systems with different light amount distributions are used. Since a conventional multi-beam system has a uniform light amount distribution, the exposing units may be considered to be of a single-type optical system.

A description will be given of a case of using a conventional semiconductor laser oscillator.

A semiconductor laser oscillator requires reduction in diameter of a laser beam by means of a lens. In the case of a laser beam with a wavelength of about 750 nm, the diameter of the beam can be reduced only to a level of about 70 to 90 $\mu$m, which is insufficient for resolution of data of 600 dpi or 800 dpi.

Figure 2:
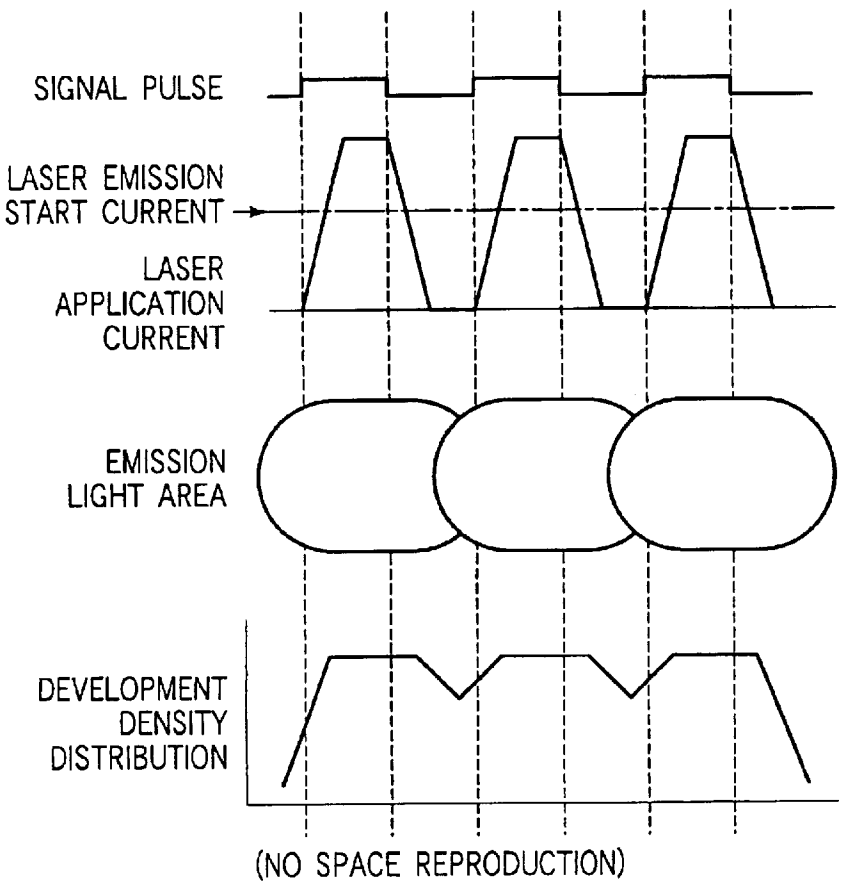
FIG. 2 is a view for explaining a case of exposure with a laser beam.

In FIG. 2, a laser beam is emitted at every other dot with a resolution of, e.g. 600 dpi. In this case, adjacent emission light areas overlap and a space cannot be reproduced.

The rising and falling of a laser application current requires a predetermined time. A laser beam is first emitted after the laser application current reaches a level of a laser emission start current.

Figure 3:
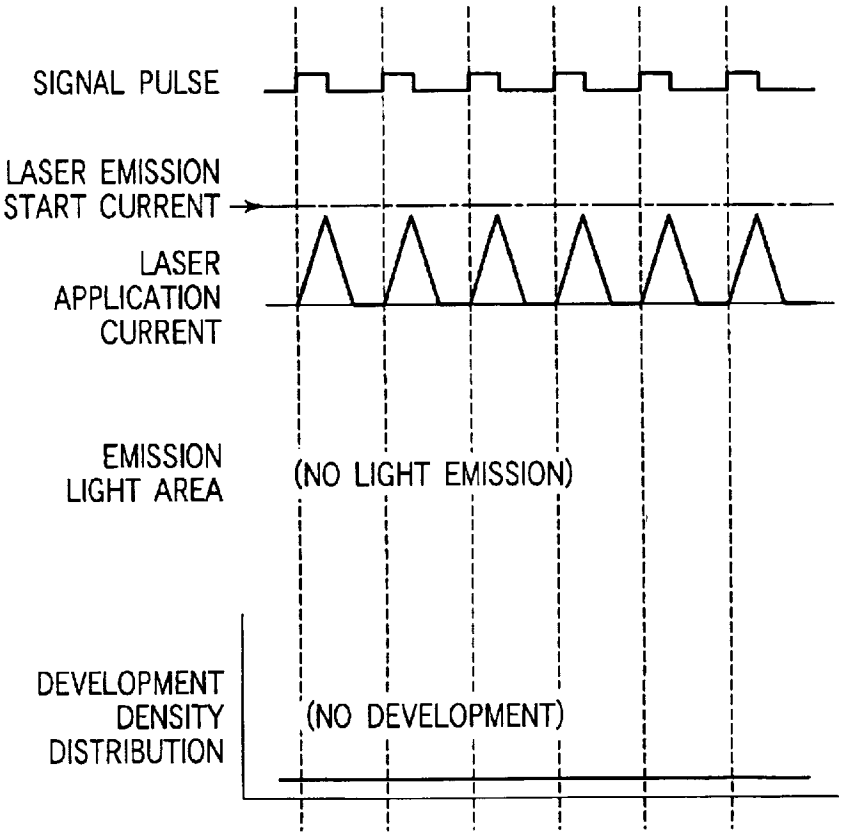
FIG. 3 is a view for explaining a case of exposure with a laser beam.

Consequently, as shown in FIG. 3, if a halftone image is to be formed using a multi-value process by pulse width modulation, a signal pulse may be turned off before the laser application current reaches the level of laser emission start current. In this case, no laser beam is emitted, or a laser beam, if emitted, disappears instantaneously. Thus, an electrostatic latent image, which can be developed, cannot be written or formed on the photosensitive body.

There is a method of multi-value processing with intensity modulation. In this case, however, a control of application current by the intensity modulation is more difficult than a control of application current by the pulse width modulation, and so this method is less practical.

Figure 4:
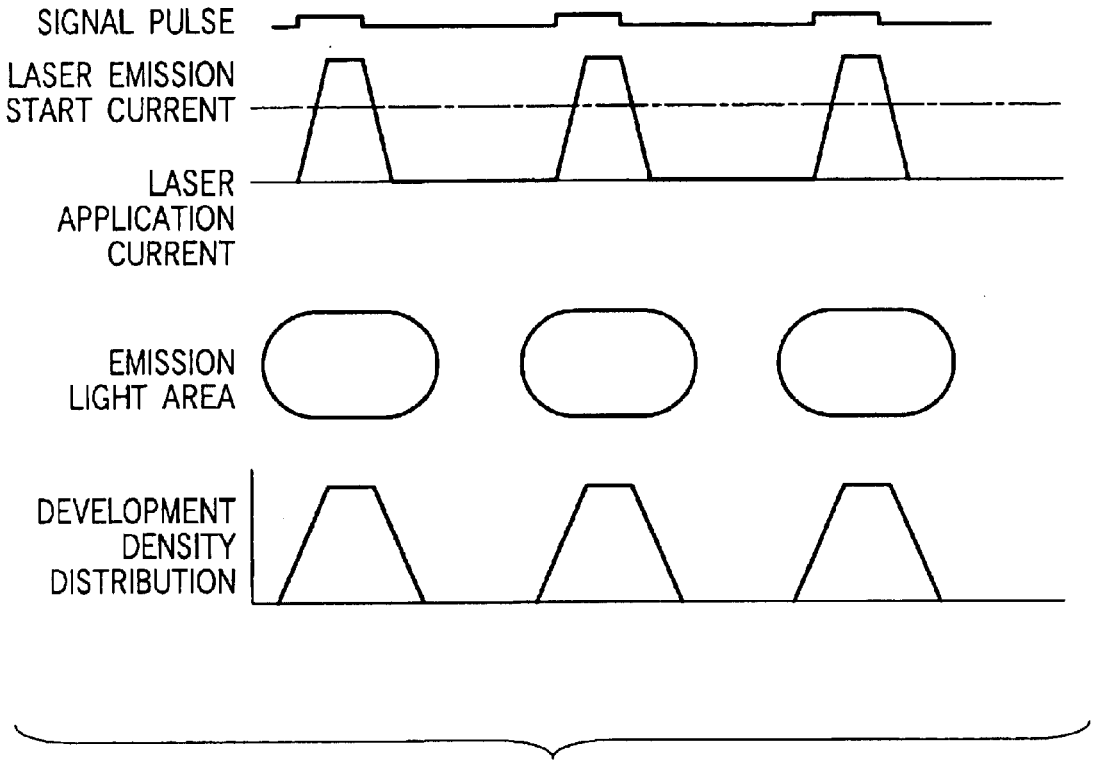
FIG. 4 is a view for explaining a case of exposure with a laser beam.

As stated above, there is a limit to the multi-value tone expression. To cope with this problem, in the prior art, the resolution is decreased, for instance, from 600 dpi to 300 dpi or 200 dpi, and a low-density part is reproduced by sparsely formed dots, as shown in FIG. 4.

Figure 5:
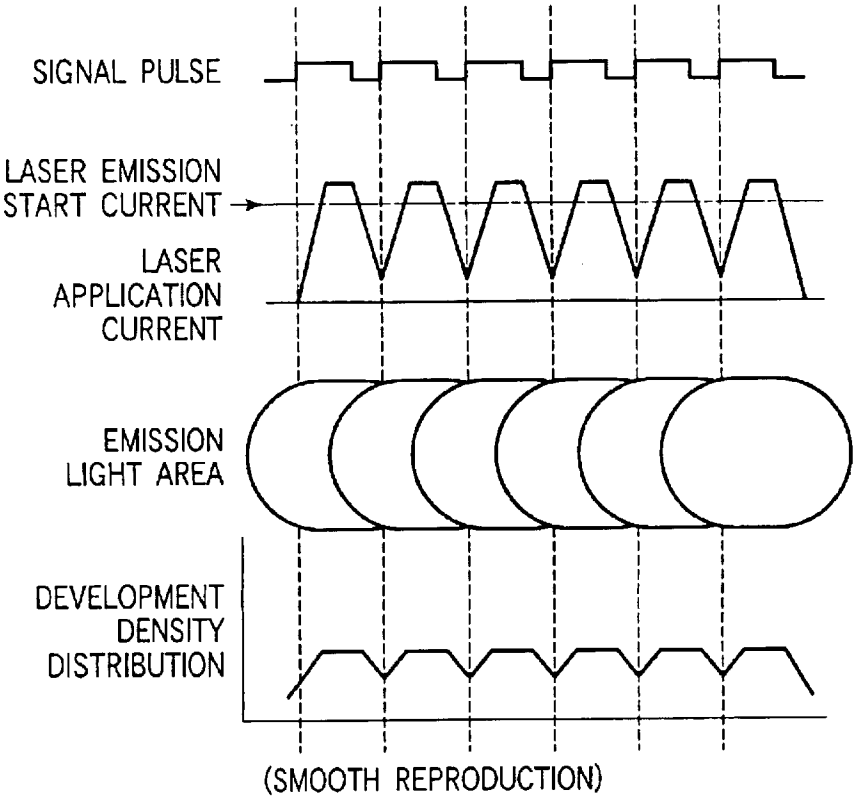
FIG. 5 is a view for explaining a case of exposure with a laser beam.

FIG. 5 illustrates a case where a low-density part is exposed using a laser with reduced power.

A description will be given of a case of using a conventional LED optical system.

When the respective LED elements are used in a full turn-on state, a variance in light amount among the LED elements can be controlled, and clear development can be effected.

Figure 6:
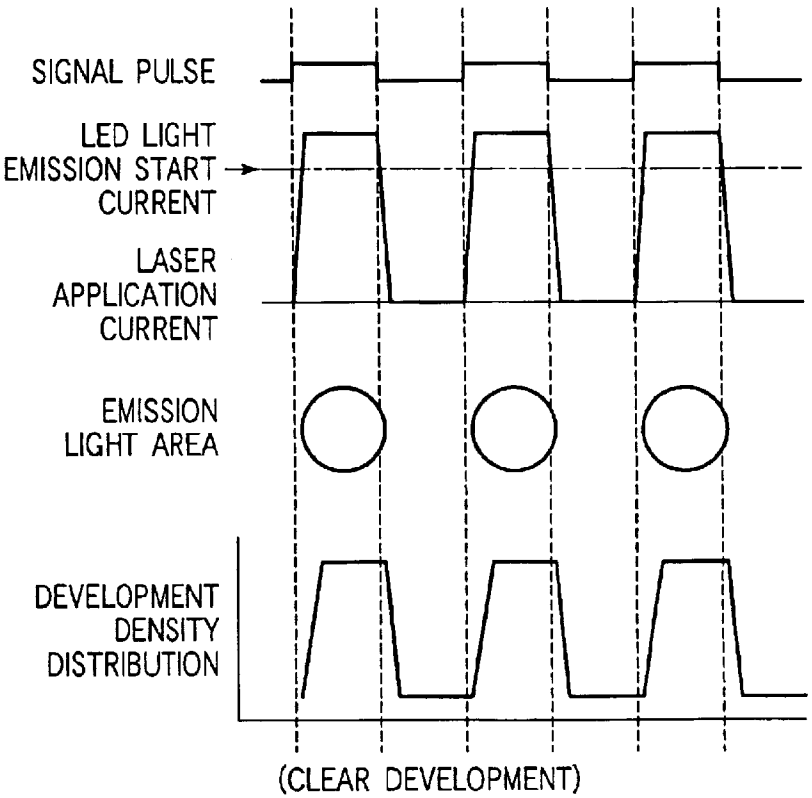
FIG. 6 is a view for explaining a case of exposure with an LED optical system.

As is shown in FIG. 6, an electrostatic latent image with a high resolution and a high MTF can be obtained. However, when multi-value tone expression is effected, a variance in light amount among LED elements is very large and unstable, and it is uncontrollable. If multi-value processing is employed in order to express a halftone image with a high image quality, the image quality is, rather, worsened due to non-uniformity of the latent image resulting from the variance in light amount. Consequently, the resolution is decreased, for instance, from 600 dpi to 300 dpi or 200 dpi, and a low-density part is reproduced.

A first embodiment of the invention will now be described.

Figure 7:
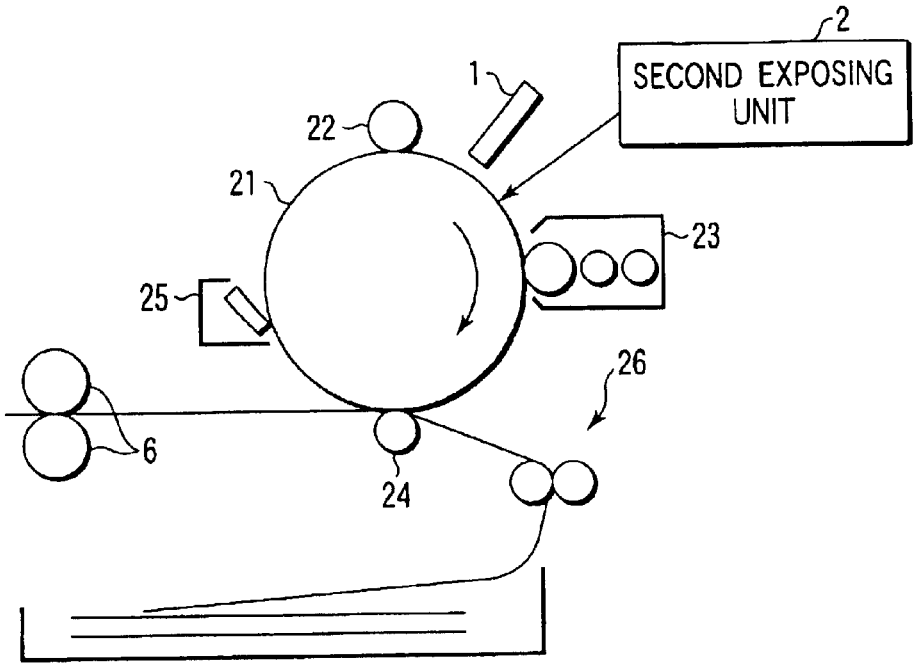
FIG. 7 shows the structure of a photosensitive drum and related components in a digital electro-photographic image forming apparatus according to a first embodiment.

FIG. 7 shows the structure of a photosensitive drum 21 and related components in a digital electro-photographic image forming apparatus according to the first embodiment.

The photosensitive drum 21 is rotated by a motor (not shown) in a direction of an arrow at a predetermined peripheral speed. Around the photosensitive drum 21, the following components are disposed in order in the rotational direction: a precharger 22 functioning as precharge means; a first exposing unit 1; a second exposing unit 2; a developing device 23 functioning as developing means using toner; a transfer roller 24 that transfers a toner image onto a paper sheet (transfer medium) fed from a sheet feeder 26; and a cleaner 25 that removes residual toner, etc., from the surface of the photosensitive drum 21.

The sheet, on which the toner image has been transferred, is conveyed to the fixing device 6 by convey means (not shown) controlled by the convey control unit 16. The fixing device 6 heats the sheet at a predetermined temperature, thereby fusing the toner image transferred on the sheet and fixing the toner image on the sheet.

Assume that the digital electrophotographic image forming apparatus according to the first embodiment has an image write resolution of 600 dpi.

The first exposing unit 1 employs an LED element with $\phi$50 $\mu$m in order to expose an edge part.

The second exposing unit 1 uses a semiconductor laser oscillator 4 with a converged beam of $\phi$90 $\mu$m (about double the data interval) obtained by adjusting a lens (not shown) and a focal distance.

The first exposing unit 1 may use a laser optical system that produces a laser beam with a reduced diameter of 40 to 70 $\mu$m using a short-wavelength laser such as a green laser or a blue laser. Alternatively, the first exposing unit 1 may use a laser optical system or an LED optical system with a write resolution of 1200 dpi or more. In this case, 600 dpi data is divided and assigned to two LED elements (front and rear) per dot. In a case of an oblique edge, only the front LED element or the rear LED element is turned on to adjust the edge position.

Further, conventional data processing may be performed, wherein write data is subjected to multi-value processing, and the light emission start point is finely adjusted, thereby smoothly expressing an oblique edge.

With the above-described structure, the CPU 10 in the first embodiment performs an exposure control by using the first exposing unit 1 when a line part and an edge part are exposed, and using the second exposing unit 2 when a halftone part and a solid part are exposed.

For example, the CPU 10 discriminates between an edge part and a solid part on the basis of image data. The CPU 10 selectively supplies data on a high-density edge part to the first exposing unit 1 (with a small spot size and a high power) and data on a low-density solid part to the second exposing unit 2 (with a large spot size and a low power). As regards a solid part with a predetermined density or more, both the first exposing unit 1 and second exposing unit 2 are used, and an exposure amount to achieve an optimal latent image potential is computed.

An image-quality mode may be set through the operation panel. In this case, image-quality modes, such as an image-quality preferential mode, a speed preferential mode, a line image preferential mode and a photo image preferential mode, may be provided (the naming of the modes is freely chosen).

For example, in the case of the image-quality preferential mode, the first exposing unit 1 and second exposing unit 2 are assigned to an edge part and a solid part over the entire range of an image.

In the case of the speed preferential mode, exposure is effected by using only the first exposing unit 1 or the second exposing unit 2.

In the case of the line image preferential mode, exposure is performed by using only the first exposing unit 1.

In the case of the photo image preferential mode, exposure is performed by using only the second exposing unit 2.

As has been described above, the exposing unit to be used is selected according to the designated image-quality mode. Thereby, the user can choose the speed and image quality.

A second embodiment of the invention will now be described.

Figure 8:
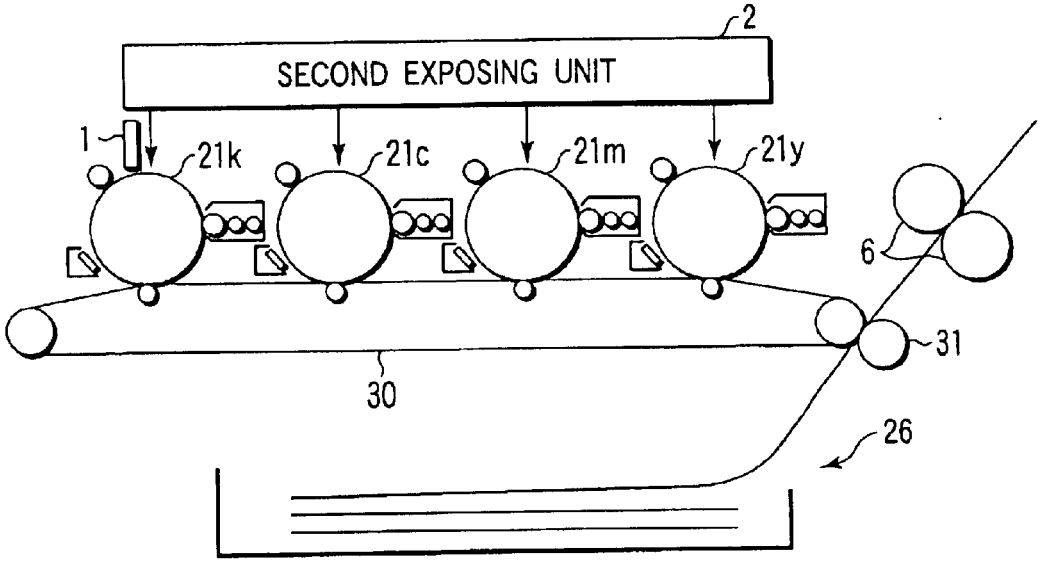
FIG. 8 shows the structure of photosensitive drums and related components in a 4-series tandem type full-color image forming apparatus according to a second embodiment.

FIG. 8 shows the structure of photosensitive drums and related components in a 4-series tandem type full-color image forming apparatus according to the second embodiment. In the 4-series tandem type full-color image forming apparatus, latent images are formed on photosensitive drums associated with the respective colors on the basis of image data that is color-separated according to the respective color components.

Specifically, the 4-series tandem type full-color image forming apparatus includes a photosensitive drum 21*y* on which a yellow (Y) latent image is formed, a photosensitive drum 21*m* on which a magenta (M) latent image is formed, a photosensitive drum 21*c* on which a cyan (C) latent image is formed, and a photosensitive drum 21*k* on which a black (K) latent image is formed.

The photosensitive drums 21*y*, 21*m*, 21*c* and 21*k* are exposed by the second exposing unit 2. Only the photosensitive drum 21*k* is provided with the aforementioned first exposing unit 1.

In the second embodiment, a toner image is transferred onto a paper sheet fed from the sheet feeder 26 by a secondary transfer roller 31 using an intermediate transfer belt 30.

An exposure control for the photosensitive drum 21*k* according to the second embodiment is effected by using the first exposing unit 1 when a line part and an edge part are exposed, and by using the second exposing unit 2 when a halftone part and a solid part are exposed. An exposure control for the photosensitive drums 21*c*, 21*m* and 21*y* is effected by using the second exposing unit 2.

A third embodiment of the invention will now be described.

Figure 9:
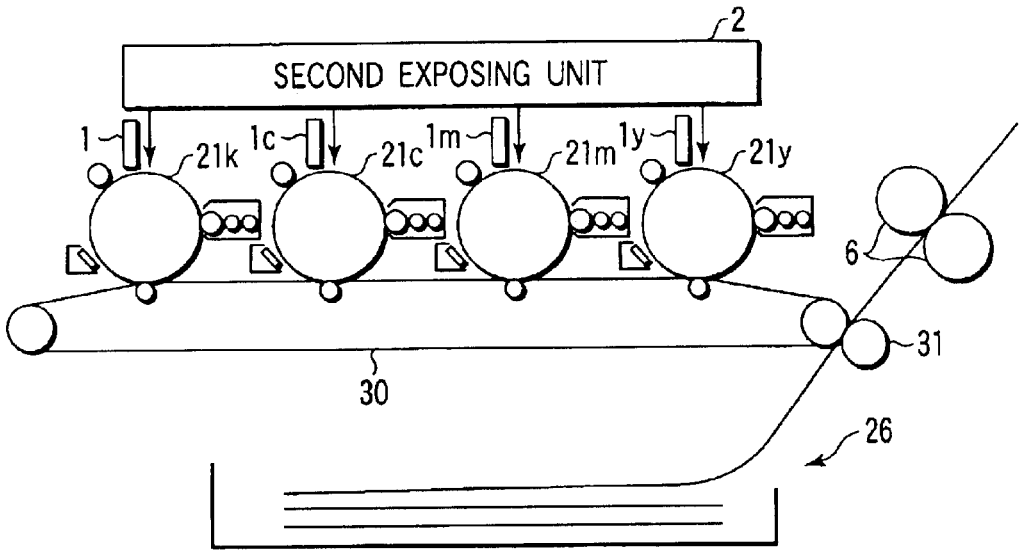
FIG. 9 shows the structure of photosensitive drums and related components in a 4-series tandem type full-color image forming apparatus according to a third embodiment.

FIG. 9 shows the structure of photosensitive drums and related components in a 4-series tandem type full-color image forming apparatus according to the third embodiment.

The 4-series tandem type full-color image forming apparatus includes a photosensitive drum 21*y* on which a yellow (Y) latent image is formed, a photosensitive drum 21*m* on which a magenta (M) latent image is formed, a photosensitive drum 21*c* on which a cyan (C) latent image is formed, and a photosensitive drum 21*k* on which a black (K) latent image is formed.

In the third embodiment, each photosensitive drum is provided with two kinds of exposing units of image write optical systems.

Specifically, the photosensitive drum 21*y* is exposed by a first exposing unit 1*y* and a second exposing unit 2. The photosensitive drum 21*m* is exposed by a first exposing unit 1*m* and the second exposing unit 2. The photosensitive drum 21*c* is exposed by a first exposing unit 1*c* and the second exposing unit 2. The photosensitive drum 21*k* is exposed by a first exposing unit 1*k* and the second exposing unit 2.

In the third embodiment, a toner image is transferred onto a paper sheet fed from the sheet feeder 26 by a secondary transfer roller 31 using an intermediate transfer belt 30.

An exposure control for the photosensitive drums 21*y*, 21*m*, 21*c* and 21*k* according to the third embodiment is effected by using the first exposing units 1*y*, 1*m*, 1*c* and 1*k* when a line part and an edge part are exposed, and by using the second exposing unit 2 when a halftone part and a solid part are exposed.

A fourth embodiment of the invention will now be described.

Figure 10:
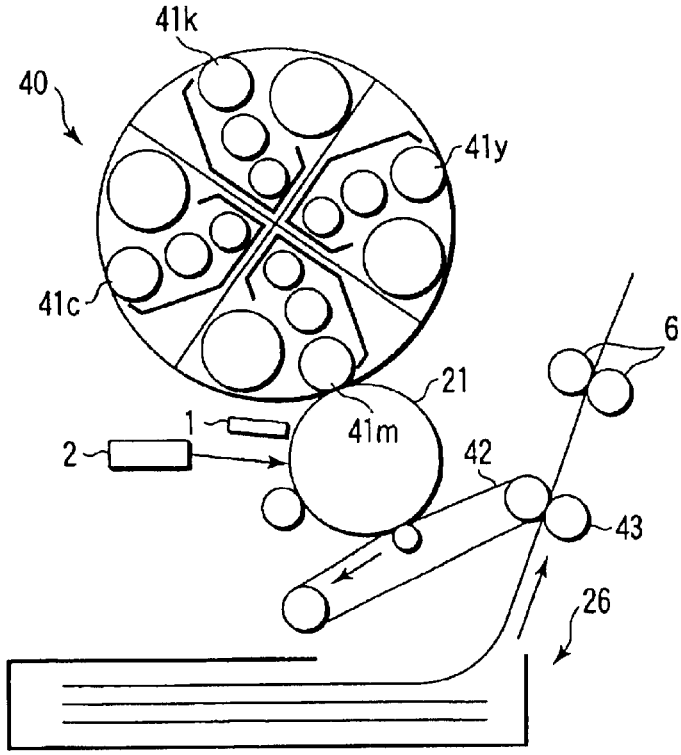
FIG. 10 shows the structure of a photosensitive drum and related components in a 4-color revolver type full-color image forming apparatus according to a fourth embodiment.

FIG. 10 shows the structure of a photosensitive drum and related components in a 4-color revolver type full-color image forming apparatus according to the fourth embodiment. In the 4-color type full-color image forming apparatus, latent images are formed by developing rollers associated with the respective colors on the basis of image data that is color-separated according to the respective color components.

Specifically, the 4-color type full-color image forming apparatus has a revolver-type rotary developing device 40. The developing device 40 includes a developing roller 41*y* for yellow (Y), a developing roller 41*m* for magenta (M), a developing roller 41*c* for cyan (C), and a developing roller 41*k* for black (K).

A photosensitive drum 21 is provided with a first exposing unit 1 and a second exposing unit 2.

In the fourth embodiment, a toner image is transferred onto a paper sheet fed from the sheet feeder 26 by a secondary transfer roller 43 using an intermediate transfer belt 42.

An exposure control for the photosensitive drum 21 according to the fourth embodiment is effected by using the first exposing unit 1 when a line part and an edge part are exposed, and by using the second exposing unit 2 when a halftone part and a solid part are exposed.

A fifth embodiment of the invention will now be described.

Figure 11:
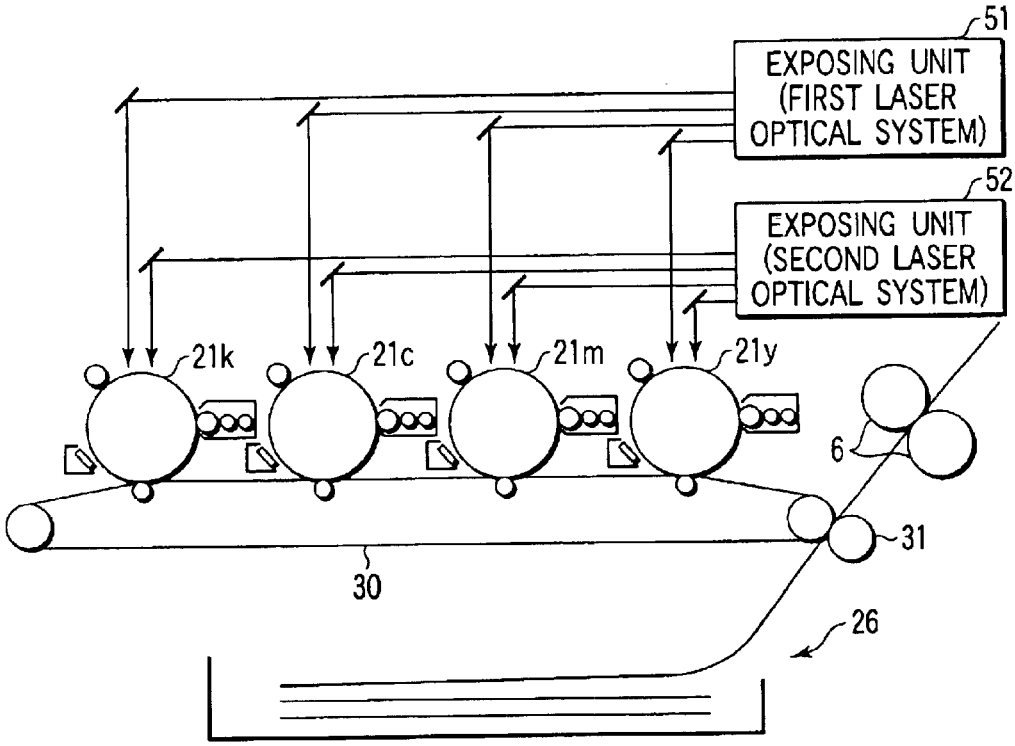
FIG. 11 shows the structure of photosensitive drums and related components in a 4-series tandem type full-color image forming apparatus according to a fifth embodiment.

FIG. 11 shows the structure of photosensitive drums and related components in a 4-series tandem type full-color image forming apparatus according to the fifth embodiment.

In the 4-series tandem type full-color image forming apparatus according to the fifth embodiment, four photosensitive drums are provided with two exposing units of multi-beam laser optical systems.

Specifically, photosensitive drums 21*y*, 21*m*, 21*c* and 21*k* are exposed by an exposing unit 51 of a first laser optical system or an exposing unit 52 of a second laser optical system.

For example, when an image write resolution is 600 dpi, the exposing unit 51 of the laser optical system operates with conditions that the emission light beam diameter is ϕ70 μm, the drive current is 60 mA, and the light emission output at full turn-on time is 7.4 mW. When the first laser optical system exposing unit 51 is caused to emit light with a duty ratio of 80%, the surface potential of the photosensitive body which is charged at 700 V can be reduced to 50 V and the exposing unit 51 is usable for exposing an edge part and a line part.

On the other hand, the second laser optical system exposing unit 52 operates with conditions that the emission light beam diameter is ϕ90 μm, the drive current is 40 mA, and the light emission output is 2.8 mW. When the laser optical system 52 is operated in a full turn-on state, the surface potential of the photosensitive body which is charged at 700 V can be reduced to 350 V and the exposing unit 52 is usable for exposing a halftone part and a solid part.

A sixth embodiment of the invention will now be described.

Figure 12:
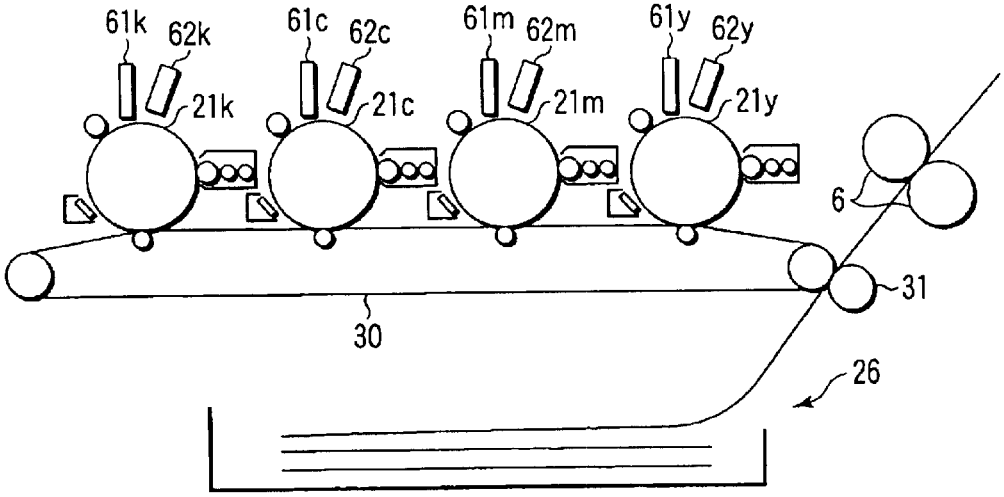
FIG. 12 shows the structure of photosensitive drums and related components in a 4-series tandem type full-color image forming apparatus according to a sixth embodiment.

FIG. 12 shows the structure of photosensitive drums and related components in a 4-series tandem type full-color image forming apparatus according to the sixth embodiment.

In the 4-series tandem type full-color image forming apparatus of the sixth embodiment, each of the four photosensitive drums is provided with two kinds of LED optical systems (exposing units).

Specifically, a photosensitive drum 21*y* is exposed by an LED optical system 61*y* or an LED optical system 62*y*. A photosensitive drum 21*m* is exposed by an LED optical system 61*m* or an LED optical system 62*m*. A photosensitive drum 21*c* is exposed by an LED optical system 61*c* or an LED optical system 62*c*. A photo-sensitive drum 21*k* is exposed by an LED optical system 61*k* or an LED optical system 62*k*.

Figure 13:
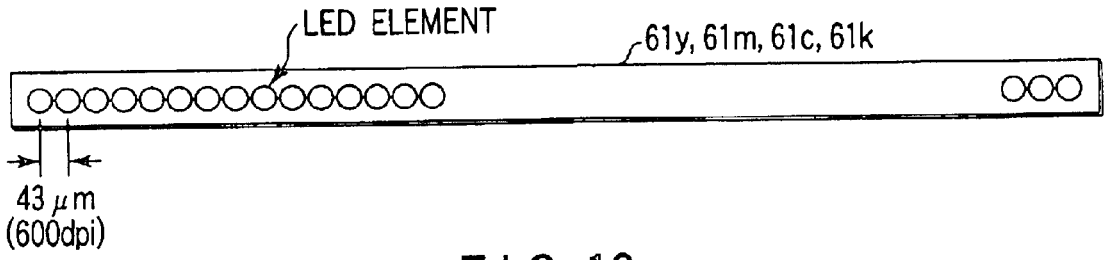
FIG. 13 is a view for explaining the structure of LED elements in an exposing unit of an LED optical system.

For example, in the case of an image write resolution of 600 dpi, the LED optical systems 61*y*, 61*m*, 61*c* and 61*k* are fabricated, as shown in FIG. 13, with an LED (light-emitting diode) element size of ϕ43 μm and an arrangement interval of 43 μm. Each LED optical system operates with an application current of 20 mA and a light emission output of 6 mW. When the LED optical systems 61*y*, 61*m*, 61*c* and 61*k* are operated in a full turn-on state, the surface potential of the photosensitive body which is charged at 750 V can be reduced to 100 V. These LED optical systems are usable for exposing an edge part and a line part.

Figure 14:
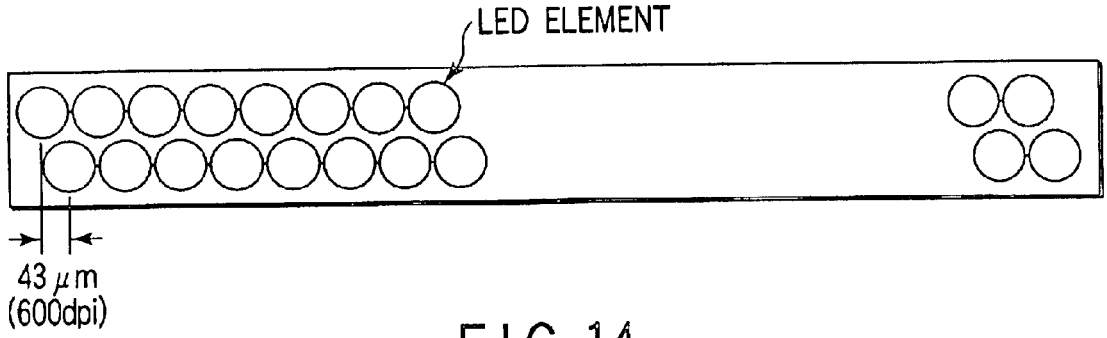
FIG. 14 is a view for explaining the structure of LED elements in an exposing unit of an LED optical system.

On the other hand, the LED optical systems 62*y*, 62*m*, 62*c* and 62*k* are fabricated, as shown in FIG. 14, with an LED (light-emitting diode) element size of ϕ90 μm and an arrangement interval of 43 μm. Each LED optical system operates with an application current of 10 mA and a light emission output of 3.1 mW. When the LED optical systems 62*y*, 62*m*, 62*c* and 62*k* are operated in a full turn-on state, the surface potential of the photosensitive body which is charged at 700 V can be reduced to 400 V. These LED optical systems are usable for exposing a halftone part and a solid part.

The diameter of a laser beam emitted from the semiconductor laser oscillator is determined by a wavelength of the laser beam, a lens (not shown) and an optical path length.

The emission light diameter of the LED element in the LED optical system varies depending on the area of each element formed on the substrate.

As has been described above, according to the embodiments of the present invention, a high-quality image having both satisfactory line-part sharpness and solid-part graininess can be formed.

An image forming apparatus according to the embodiment of the invention includes an electro-photographic developing device, a photosensitive body, a precharger for precharging the photosensitive body, and a plurality of image write optical systems (exposing units) for forming electrostatic latent images on the photosensitive body. The respective optical systems have different optical intensities and/or light amount distributions. Each optical system exposes an optimal image pattern. Thereby, all image patterns can be reproduced with high quality.

An image forming apparatus according to the embodiment of the invention includes an electro-photographic developing device, a photosensitive body, a precharger for precharging the photosensitive body, and two kinds of image write optical systems (exposing units) for forming electrostatic latent images on the photosensitive body. One of the optical systems has an optimal light amount distribution for exposing a halftone part and a solid part, and the other has an optimal light amount distribution for exposing a line part and an edge part. Specifically, in the optical system for exposing a halftone part and a solid part, the emission light diameter is adjusted at 1.5 to 10 times the data resolution, and preferably at 2 to 4 times the data resolution. In the optical system for exposing a line part and an edge part, the emission light diameter is adjusted at 0.8 to 1.5 times the data resolution, and preferably at 0.9 to 1.2 times the data resolution. Using the two optical systems, various high-quality image patterns can be reproduced with a sharp, high-resolution edge part of a line image, and a smooth, high-uniformity halftone part of a solid image.

An image forming apparatus according to the embodiment of the invention includes an electro-photographic developing device, a photosensitive body, a precharger for precharging the photosensitive body, and two kinds of image write optical systems (exposing units) for forming electrostatic latent images on the photosensitive body. One of the optical systems has an optimal light amount distribution for exposing a high-density part, and the other has an optimal light amount distribution for exposing a low-density part. Specifically, in the optical system for exposing a high-density part, the light amount is set at 90 to 150%, and preferably 100 to 120%, of a light amount necessary for obtaining an electrostatic latent image representing a maximum density. On the other hand, in the optical system for exposing a low-density part, the light amount is set at 20 to 90%, and preferably 30 to 60%, of a light amount necessary for obtaining an electrostatic latent image representing a maximum density. Using the two optical systems, uniform, high-quality images can be reproduced over the whole range of density.

An image forming apparatus according to the embodiment of the invention includes an electro-photographic developing device, a photosensitive body, a precharger for precharging the photosensitive body, and, for example, two kinds of image write optical systems (exposing units) for forming electrostatic latent images on the photosensitive body. The two exposing systems are selectively used according to an image output mode. In this case, the user can select an image-quality preferential low-speed mode, a speed preferential standard image-quality mode, a line image-quality preferential mode, or a halftone preferential mode (e.g. for photo images). Thereby, various users' needs can be satisfied. Further, three or more kinds of image write optical systems may be provided to optimize the optical system.

An image forming apparatus according to the embodiment of the invention includes an electro-photographic developing device, a photosensitive body, a precharger for precharging the photosensitive body, and two exposing units of an LED optical system and a laser optical system for one photosensitive body for forming electrostatic latent images on the photo-sensitive body. The LED optical system is suited to a line image/edge part since it can reduce an emission light diameter, and the laser optical system is suited to a halftone part/solid part. By selectively using the optical systems based on their characteristics, optimal electrostatic latent images for all kinds of image patterns can be formed, and high-quality images can be obtained.

An image forming apparatus according to the embodiment of the invention includes an electro-photographic developing device, a photosensitive body, a precharger for precharging the photosensitive body, and two exposing optical systems (exposing units) with different powers for one photosensitive body for forming electrostatic latent images on the photo-sensitive body. The optical systems with two different powers are used selectively between a line and a solid and between a high-density part and a low-density part. Thereby, it is possible to realize uniform, graininess-free image reproducibility for a halftone part, and sharp, high-resolution image reproducibility for a line image.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus that includes a photosensitive body, on which an electrostatic latent image is formed, and forms an image, the apparatus comprising:

a first exposing unit that effects exposure with a first light amount distribution, thereby forming an electrostatic latent image on the photosensitive body;

a second exposing unit that effects exposure with a second light amount distribution, differently from the first exposing unit, thereby forming an electrostatic latent image on the photosensitive body; wherein the first exposing unit and the second exposing units are distinct and a control unit that effects a control to expose the photosensitive body using one of the first exposing unit and the second exposing unit in accordance with image data for image formation wherein the control unit uses the second exposing unit to expose a solid part of image data, and uses the first exposing unit to expose an edge part of image data.

2. The image forming apparatus according to claim 1, wherein the first exposing unit is an exposing device using an LED element, and the second exposing unit is an exposing device using a semiconductor laser.

3. The image forming apparatus according to claim 1, wherein an application current is different between the first exposing unit and the second exposing unit.

4. The image forming apparatus according to claim 1, wherein the first exposing unit and the second exposing unit are exposing devices using semiconductor lasers with different application currents.

5. The image forming apparatus according to claim 1, wherein the first exposing unit and the second exposing unit are exposing devices using semiconductor lasers with different wavelengths.

6. The image forming apparatus according to claim 1, wherein the first exposing unit and the second exposing unit are exposing devices using LED elements with different application currents.

7. The image forming apparatus according to claim 1, wherein the first exposing unit and the second exposing unit are exposing devices using LED elements with different emission light diameters.

8. The image forming apparatus according to claim 1, wherein the control unit uses the second exposing unit to expose a low-density part of image data, and uses the first exposing unit to expose a high-density part of image data.

9. The image forming apparatus according to claim 1, wherein the control unit effects a control to selectively use the first exposing unit and the second exposing unit in accordance with a preset image output mode.

10. An image forming apparatus that includes a plurality of photosensitive bodies, on which electrostatic latent images are formed, and forms an image, the apparatus comprising:

a plurality of first exposing units that effect exposure with a first light amount distribution, thereby forming an electrostatic latent image on each of the plurality of photosensitive bodies;

a plurality of second exposing units that effect exposure with a second light amount distribution, differently from the plurality of first exposing units, thereby forming an electrostatic latent image on each of the plurality of photosensitive bodies; wherein the plurality of the first exposing unit and the plurality of the second exposing units are distinct and a control unit that effects a control to expose the plurality of photosensitive bodies using the plurality of first exposing units or the plurality of second exposing units in accordance with image data for image formation wherein the control unit uses the plurality of second exposing units to expose a solid part of image data, and uses the plurality of first exposing units to expose an edge part of image data.

11. The image forming apparatus according to claim 10, wherein each of the plurality of first exposing units is an exposing device using an LED element, and each of the plurality of second exposing units is an exposing device using a semiconductor laser.

12. The image forming apparatus according to claim 10, wherein an application current is different between the plurality of first exposing units and the plurality of second exposing units.

13. The image forming apparatus according to claim 10, wherein the plurality of first exposing units and the plurality of second exposing units are exposing devices using semiconductor lasers with different application currents.

14. The image forming apparatus according to claim 10, wherein the plurality of first exposing units and the plurality of second exposing units are exposing devices using semiconductor lasers with different wavelengths.

15. The image forming apparatus according to claim 10, wherein the plurality of first exposing units and the plurality of second exposing units are exposing devices using LED elements with different application currents.

16. The image forming apparatus according to claim 10, wherein the plurality of first exposing units and the plurality of second exposing units are exposing devices using LED elements with different emission light diameters.

17. The image forming apparatus according to claim 10, wherein the control unit uses the plurality of second exposing units to expose a low-density part of image data, and uses the plurality of first exposing units to expose a high-density part of image data.

18. An image forming method for an image forming apparatus that includes a photosensitive body, on which an electrostatic latent image is formed, and forms an image, the method comprising:

Choosing one of a first light amount distribution from a first exposing unit of the image forming apparatus and a second light amount distribution from a second exposing unit of the image forming apparatus different from the first light amount distribution;

said choosing step to effect a control to expose the photosensitive body, when an electrostatic latent image is formed on the photosensitive body, said choosing step being in accordance with image data for image formation, wherein the second light amount distribution exposes a solid part of image data, and the first light amount distribution exposes an edge part of the image.

* * * * *